US005293764A

United States Patent [19]

Guzzinati

[11] Patent Number: 5,293,764

[45] Date of Patent: Mar. 15, 1994

[54] SAFETY LOCK FOR HOUSE DOORS AND THE LIKE

[75] Inventor: Alberto Guzzinati, Sant'Ambrogio, Italy

[73] Assignee: Mottura Serrature Di Sicurezza S.p.A., Sant'Ambrogio, Italy

[21] Appl. No.: 992,767

[22] Filed: Dec. 18, 1992

[30] Foreign Application Priority Data

Dec. 18, 1991 [IT] Italy ..... TO91 A000996

[51] Int. Cl.[5] ..... E05B 29/04

[52] U.S. Cl. ..... 70/365; 70/366; 70/495; 70/496

[58] Field of Search ..... 70/365, 366, 377, 495, 70/496

[56] References Cited

U.S. PATENT DOCUMENTS

| | | | |
|---|---|---|---|
| 419,091 | 1/1890 | Williams | 70/496 |
| 671,326 | 4/1901 | Soley | 70/365 |
| 2,036,747 | 4/1936 | Fitzgerald | 70/496 |
| 3,604,231 | 9/1971 | Buschi | 70/496 |
| 3,733,863 | 5/1973 | Toepfer | 70/496 |

FOREIGN PATENT DOCUMENTS

| | | | |
|---|---|---|---|
| 507106 | 9/1930 | Fed. Rep. of Germany | 70/366 |
| 1553448 | 9/1970 | Fed. Rep. of Germany | 70/365 |
| 1564494 | 3/1969 | France | 70/365 |
| 275724 | 9/1951 | Switzerland | 70/365 |

*Primary Examiner*—Lloyd A. Gall
*Attorney, Agent, or Firm*—Sughrue, Mion, Zinn, Macpeak & Seas

[57] ABSTRACT

A safety lock for house doors and the like, adapted to be operated by a key having a front active profile (3), comprises an outer drum member (4), a cylindrical body (9) rotatably mounted with respect to the drum member and arranged within the latter and a number of safety plates (29) having notches (29*a*), housed internally to a cavity (13) of the cylindrical body and pivotally mounted around a pin (30). A tab (27) prevents, when the lock is locked, the rotation of the cylindrical body (9) with respect to the drum member (4). By inserting the key in the keyhole, the safety plates reach a reciprocal position which is such that the notches (29*a*) define a seat which receives the tab (27) thereby unlocking the lock. A cam member (33), which is tiltalble around the pin (30) and is urged by a spring (24), brings the tab back in the locking position when the key is withdrawn. By the oscillating arrangement of the safety plates (29) and the cam member (33), a lock of reduced axial bulk is obtained.

4 Claims, 3 Drawing Sheets

SAFETY LOCK FOR HOUSE DOORS AND THE LIKE

BACKGROUND OF THE INVENTION

The present invention relates to safety locks for house doors and the like and particularly to safety locks adapted to be operated by keys having a front active profile, of the type comprising:

- an outer drum member which is to be fixed to the lock casing, having a substantially cylindrical inner cavity,
- a cylindrical body which is coaxially and rotatably supported within the inner cavity of the drum member, said cylindrical body having an inner cavity opening on its rear face,
- a disk covering the inner cavity of the cylindrical body and connected to the rear face of the latter, said disk having an aperture in correspondence with the axis of the cylindrical body,
- a T-shaped element having a stem slidably mounted within the axial aperture of said covering disk along the axis of the cylindrical body and a portion including the T-brackets housed within the cavity of said cylindrical body, said brackets having ends slidably mounted within longitudinal grooves formed in the surface of the inner cavity of the cylindrical body,
- a tab-like locking member slidably mounted within a slot formed radially through the wall of the cylindrical body, the radially outer end of said tab member being adapted to engage a cooperating cavity formed on the inner wall of the drum member to prevent a rotation of the cylindrical body with respect to the drum member,
- a plurality of safety plates arranged parallel to each other side by side, said plates having notches and being housed within said cavity of the cylindrical body so as to move freely in their planes with respect to each other, said notches defining a seat for receiving the inner end of said tab member when said plates reach a predetermined position with respect to each other, and
- cam means, within the inner cavity of said cylindrical body, in contact with said tab member and adapted to hold the tab member in a position in which it engages said cavity in the drum member.

Locks of this type have been known and marketed in Italy by the Applicant for a long time and have the inconvenience of a relatively big axial bulk, due at least in part to the need of providing sufficient space for the movement of the safety plates, which are slidably mounted within the cylindrical body.

SUMMARY OF THE INVENTION

In order to overcome said inconvenience, the present invention provides a lock of the above indicated type, characterized in that said safety plates are pivotally mounted around an axis perpendicular to the axis of said cylindrical body. In this manner, the space along the longitudinal direction which is necessary for the movement of the safety plates can be reduced, obtaining a lock having a lower axial bulk with respect to the above indicated known lock, and providing at the same time a solution of easy and costless manufacture.

BRIEF DESCRIPTION OF THE DRAWINGS

Further features and advantages of the invention will become apparent from the following description with reference to the annexed drawings, given purely by way of non-limiting example, in which.

DETAILED DESCRIPTION OF THE INVENTION

Figure 1:
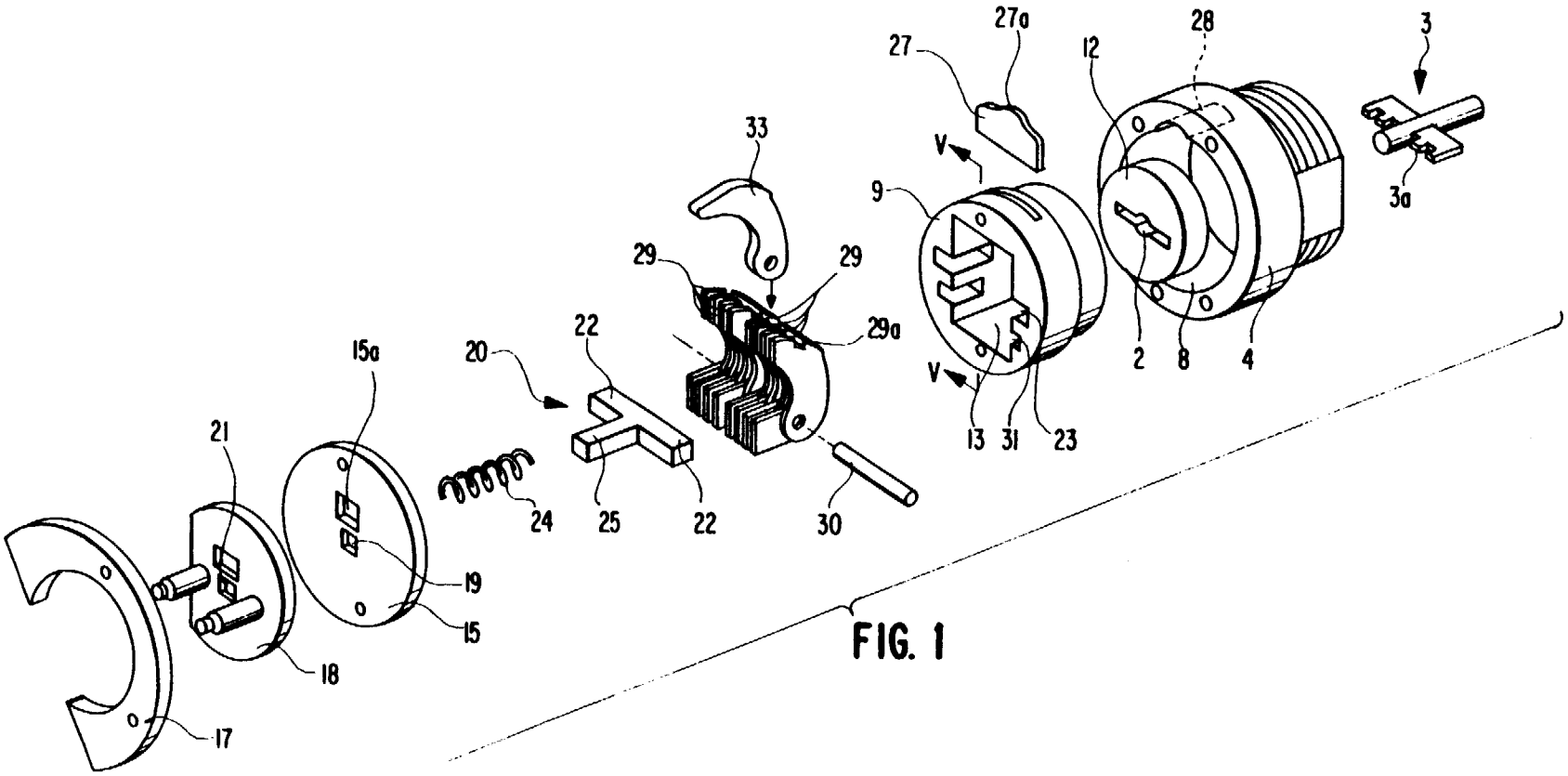
FIG. 1 is an exploded view of the lock according to the present invention.

With reference to the drawings, the lock 1 comprises an outer drum member 4 with a cylindrical wall 4a and a front wall 10. The cylindrical wall 4a has an outer surface including a threaded portion 5 and a shoulder 6 which cooperates with an annular threaded ring screwed on the threaded portion 5 for fixing the drum member 4 to the casing (not shown) of the lock. The drum member 4 has an inner cavity 8 opening on the rear side of said drum member, wherein there is rotatably mounted a cylindrical body 9 in contact with the inner surface 10a of the front wall 10 of the drum member 4. The cylindrical body 9 has an inner cavity with a front portion 11 in which there is fixed a reinforceing disk of a drill-resistant hard material, and with a rear portion 13 opening on a rear face 14 of the cylindrical body 9. On the rear face 14 there is fixed a closing disk 15 by means of screws 16 screwed on the cylindrical body 9. The cylindrical body and the covering disk 15 are fully received within the cavity 8 of the drum member 4 on whose rear surface there is fixed a C-shaped plate 17 which prevents the cylindrical body 9 from moving outside of the drum member. A driving disk 18 for the lock bolt is rotatably mounted within the C-shaped plate 17 and is held in contact with the covering disk 15 by the bolt mechanism. The details relating to the bolt and the way by which it is driven by the disk 18, as well as the knob or lever driving the lock from the inside, are not illustrated herein, since they are of a type known per se and do not fall within the scope the invention.

Figure 5:
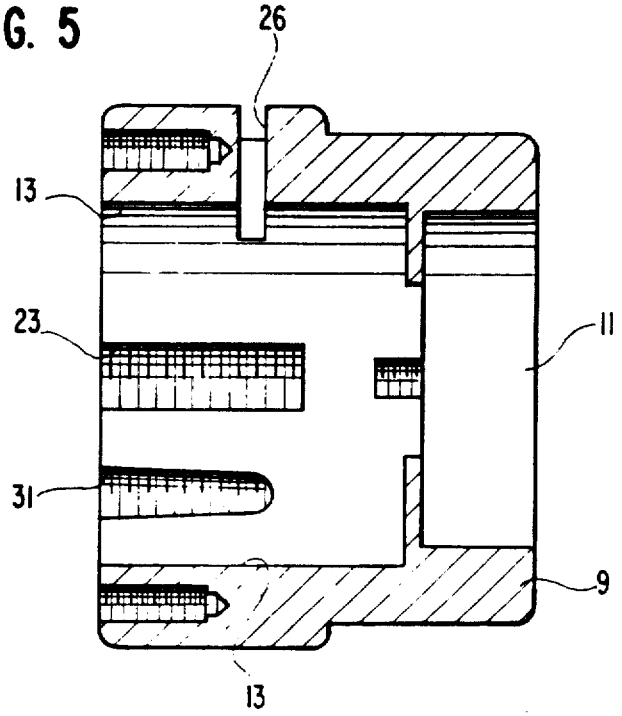

On the covering disk 15 there is formed a coaxial hole 19 in which there is slidably mounted the stem 25 of a T-shaped element 20. A similar and corresponding coaxial hole 21 is formed on the driving disk 18. The two brackets 22 (see FIG. 1) of the T-shaped element 20 are slidably mounted within cooperating axial grooves 23 (see FIG. 5) formed on the surface of the inner cavity 13. A helical spring 24 is coaxially mounted on the stem 25 of the T-shaped element 20 and is interposed between the covering disk 15 and the brackets 22 of the T-shaped element, inside the inner cavity 13.

A slot 26 extends radially through the wall of the cylindrical body 9 and a tab member 27 is slidably mounted in said slot along a radial direction. On the surface of the inner cavity 8 of the drum member 4 there is formed a cavity 28 which can receive a crescent-shaped appendage 27a projecting from the upper edge of the tab member 27. A plurality of safety plates 29 are housed in the inner cavity 13, each plate been mounted so that it can tilt in its plane independently from the others, around a cylindrical pin 30, arranged transversely with respect to the axis of the cylindrical body 9, the ends of this pin being received in cavities 31 formed in the surface of the inner cavity 13. The safety plates 29 have notches 29a in positions offset from each other and are spaced from each other by a plurality of spacing plates 32 which also are pivoted on the pin 30. Said spacing plates 32 are prevented from rotating around pin 30 because of their shape which matches the shape of the lower surface of the inner cavity 13. In a central position with respect to the plurality of safety plates 29, there is located a cam member 33 which is pivotally mounted on the pin 30 and has an upper surface 34 whose function will become clear hereinafter. The front wall 10 of the drum member 4 and the reinforcing disk 12 have corresponding apertures which define a keyhole 2 having a profile so shaped as to allow introduction of a key 3 having a front active profile 3a on a cross piece only in one of the two possible angular orientations of the key with respect to its axis.

The operation of the above described lock is as follows.

Figure 2:
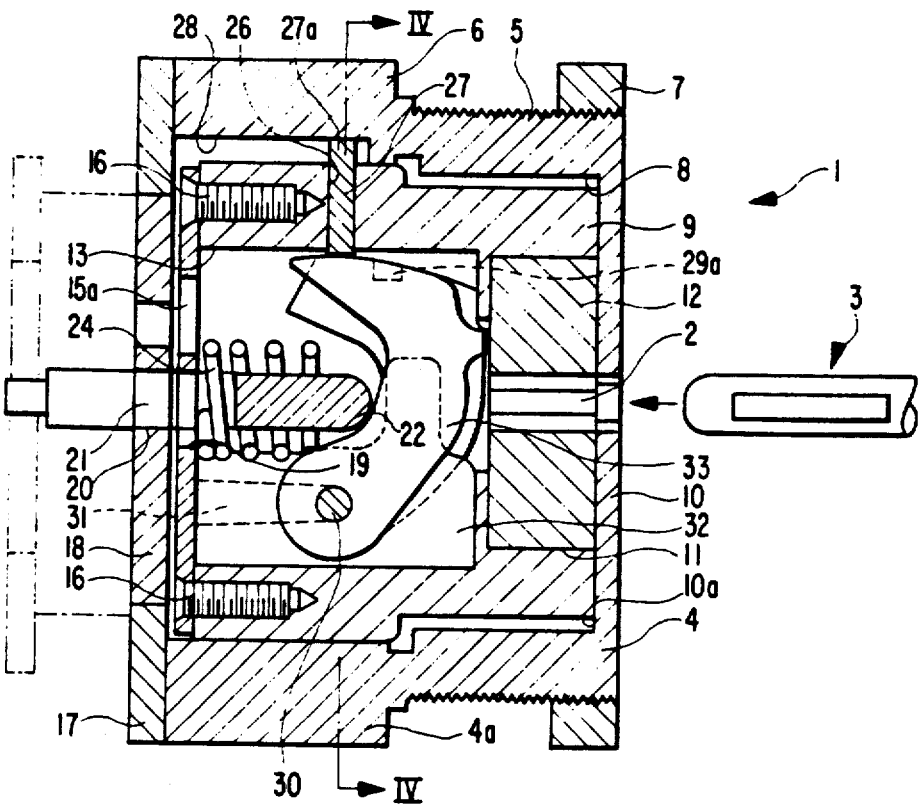
FIG. 2 is a cross-sectional side view showing the locking condition.

In the locking condition of the lock (as visible in FIG. 2), when the key 3 is not inserted in the key hole 2, the spring 24 urges the T-shaped element 20 in a position in which the stem 25 does not engage the hole 21 on the bolt driving disk 10, and in which the brackets 22 urge the safety plates 29 and the member 33 in the position indicated in FIG. 2. In this condition, the upper surface 34 of the cam member 33 urges the tab member 27 in the radially outward position shown in FIG. 2, so that the upper appendage 27a engages the cavity 28 of the drum member 4. In this manner, the rotation of the cylindrical body 9 with respect to the drum member 4 is prevented and therefore it is not possible to operate the bolt from the outside of the door, whereas this is possible from the inside, since the driving disk 18 is free to rotate for example under the action of a knob (not shown).

Figure 3:
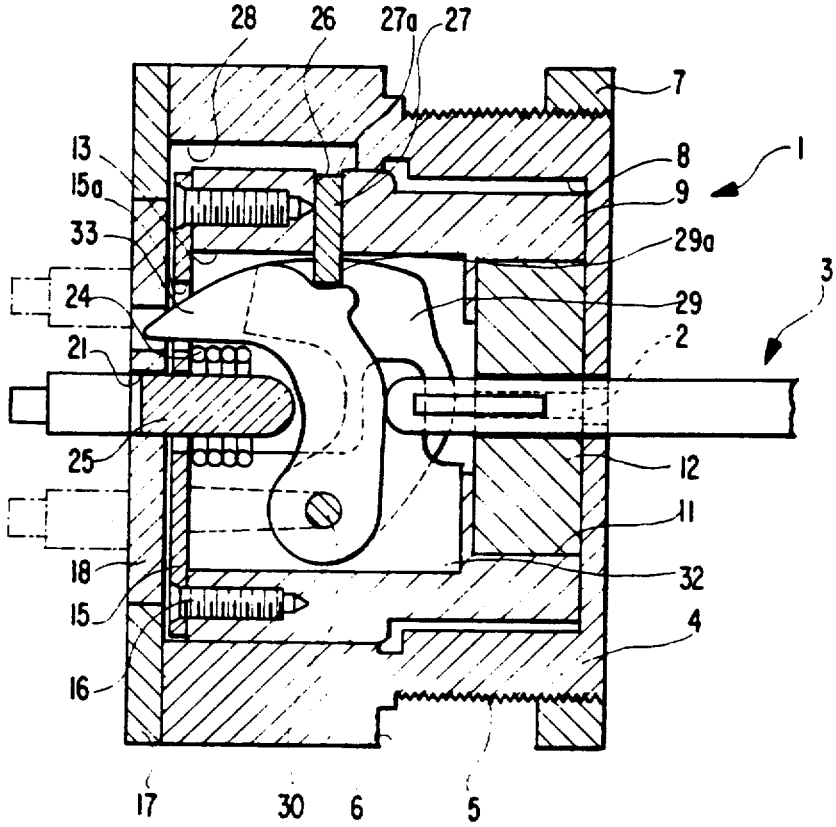
FIG. 3 is a cross-sectional side view corresponding to that of FIG. 2 and showing the opening condition.
Figure 4:
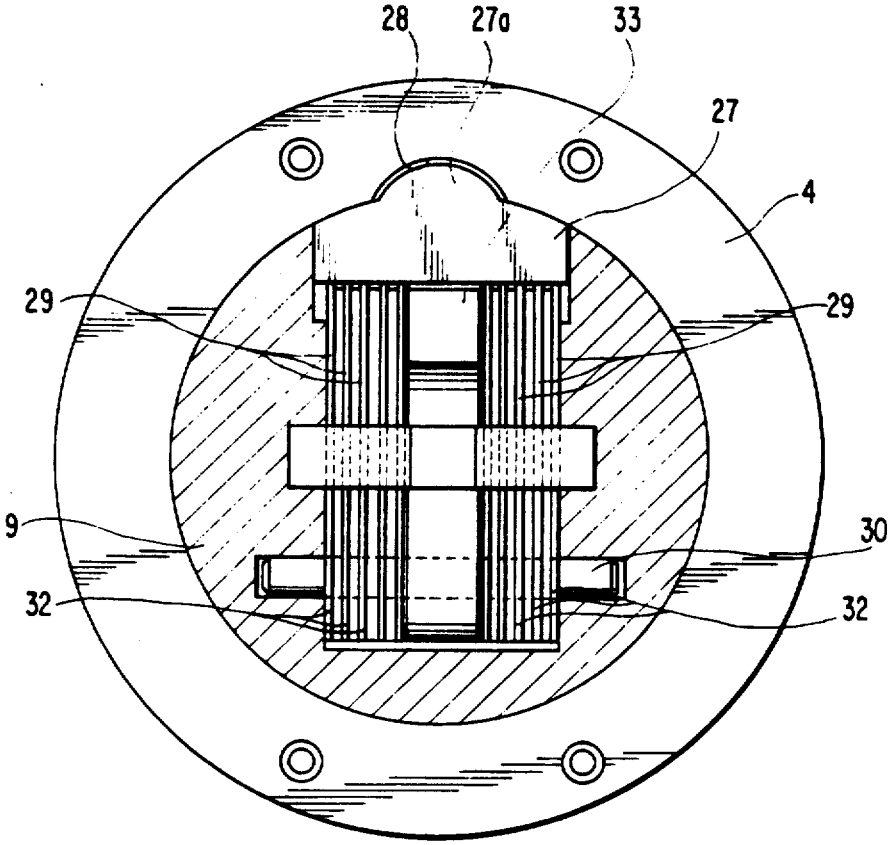
FIG. 4 is a cross-section taken along IV—IV of FIG. 2 and, FIG. 5 is a cross-section taken along line V—V of FIG. 1.

When the key 3 is inserted in the key hole 2, the front tip of the key, which has no projections, pushes the cam member 33 backwardly against the action of the spring 24, bringing the stem 25 of the T-shaped element 20 to engage the axial hole 21 in the driving disk 18. If the front profile on the cross piece of the key 3 has a correct sequence of projections and notches, the latter cause a reciprocal displacement of the safety plates so that the notches 29a define a tranverse seat which can recive the lower end of the tab member 27, disengaging the upper appendage 27a from the cavity 28 on the drum member 4 (FIG. 3). In this manner, the cylindrical body 9 is free to rotate with respect to the drum member if a rotation is given to the key 3, transmitting the rotation of movement to the T-shaped element 20 which engages the driving disc 18 and hence the bolt.

When the key 3 is withdrawn and the cylindrical body has been positioned again so that the appendage 27a of the tab member 27 is in the corresponding cavity 28, the spring 24 pushes the cam member 33 towards the bottom of the inner cavity 13, so as to restore the safety locking condition of the lock. The covering disk 15 has an aperture 15a to avoid interference with the cam member 33 in the insertion stage of the key.

As it is apparent from the foregoing, the pivotal mounting of plate 29 by means of the pin 30 provides a great reduction of the space; along the direction of the axis of the drum member 4, which is necessary for allowing movement of the plates. As a result of this, the overall construction of the lock is greatly reduced in dimension along the axial direction with respect to locks of the same type which have been produced heretofore.

Naturally, the principle of the invention remaining the same, the construction details and the embodiments may vary widely with respect to what has been described and illustrated purely by way of example, without departing from the scope of the present invention.

What is claimed is:

1. A lock for keys having a front active profile, comprising:

a casing an outer drum member (4) which is to be fixed to the casing of the lock, having a substantially cylindrical inner cavity, a cylindrical body (9) coaxially and rotatably supported within the cavity of the drum member, said body having an inner cavity (13) opening on its rear face, a covering disk (15) for the inner cavity of the cylindrical body, connected to the rear face of the cylindrical body and having an aperture (19) in correspondence with the axis of the cylindrical body, a T-shaped element (20) having a stem (25) which is slidably mounted within the aperture (19) in said covering disk along the axis of the cylindrical body, and a portion including brackets (22) housed within the cavity (13) of said cylindrical body, said brackets (22) having ends slidably mounted within longitudinal grooves (23) formed in the surface of the inner cavity of the cylindrical body, a tab member (27) for locking the lock which is slidably mounted within a slot (26) extending radially through a wall of the cylindrical body, a radially outer end (27a) of said tab member being adapted to engage a corresponding cavity (28) formed on an inner wall of the drum member (4) to prevent a rotation of the cylindrical body with respect to the drum member, a plurality of safety plates (29) parallel to each other and arranged side by side, and having notches (29a), said plates being housed within said cavity (13) in the cylindrical body and being free to move in their planes with respect to each other, said notches (29a) being adapted to define a seat for receiving a radially inner end of said tab member (27) when said plates have a predetermined position with respect to each other, and cam means (33) housed within said cavity (13) of said cylindrical body, in contact with said tab member (27) and adapted to hold the tab member in a position, in which the latter engages the cavity (28) on the drum member, wherein said plates (29) are pivotally mounted around an oscillation axis perpendicular to the axis of the cylindrical body.

2. Lock according to claim 1, wherein said cam means (33) include a plate which is pivotally mounted on the same axis on which said safety plates (29) are pivoted.

3. Lock according to claim 1, wherein said oscillation axis for plates (29) is defined by a cylindrical pin (30) housed in cavities (31) disposed on opposite sides of the plurality of plates, said cavities being formed on the surface of the inner cavity (13) of the cylindrical body.

4. Lock according to claim 1, further comprising a helical spring (24) coaxially mounted on the stem (25) of said T-shaped element and interposed between the covering disk (15) and the brackets (22) within said cavity (13) of the cylindrical body, said spring urging resiliently the brackets against the oscillating plates for locking the lock when a key is not inserted therein.

* * * * *